United States Patent [19]

Pennington

[11] 4,176,572

[45] Dec. 4, 1979

[54] DEVICE FOR SCORING WOOD PANELS PRIOR TO SAWING

[76] Inventor: Charles A. Pennington, 4626 Valencia Dr., La Verne, Calif. 91750

[21] Appl. No.: 871,608

[22] Filed: Jan. 23, 1978

[51] Int. Cl.[2] ..... B27G 19/04

[52] U.S. Cl. ..... 83/862; 83/879; 269/2; 144/1 R; 83/745; 83/574

[58] Field of Search ..... 83/9, 745, 574, 6, 879, 83/880, 862; 269/2; 144/1

[56] References Cited

U.S. PATENT DOCUMENTS

| | | | |
|---|---|---|---|
| 4,058,150 | 11/1977 | Pennington | 83/9 |
| 4,065,114 | 12/1977 | Pennington | 83/745 |

*Primary Examiner*—Donald R. Schran
*Attorney, Agent, or Firm*—Boniard I. Brown

[57] ABSTRACT

A dual-knife device for scribing or scoring a wood workpiece before sawing it with a motorized circular handsaw or other saw. The scoring insures a clean saw cut without splintering the wood at the edges, as is required in trimming veneer doors and wall panels. A guide bar is clamped to the workpiece to guide the saw and the scoring device. Prior to sawing, the scoring device is drawn by hand across the workpiece, guided by the same guide bar. The scoring device comprises a pair of knife blades mounted close together on a frame. The knife blades cut two parallel scribe lines or scores into the wood surface, one on each side of the kerf to be sawed. When the saw cut is made, the score lines prevent the saw blade from splintering or feathering the surface of the workpiece along the kerf line, insuring a clean cut.

10 Claims, 7 Drawing Figures

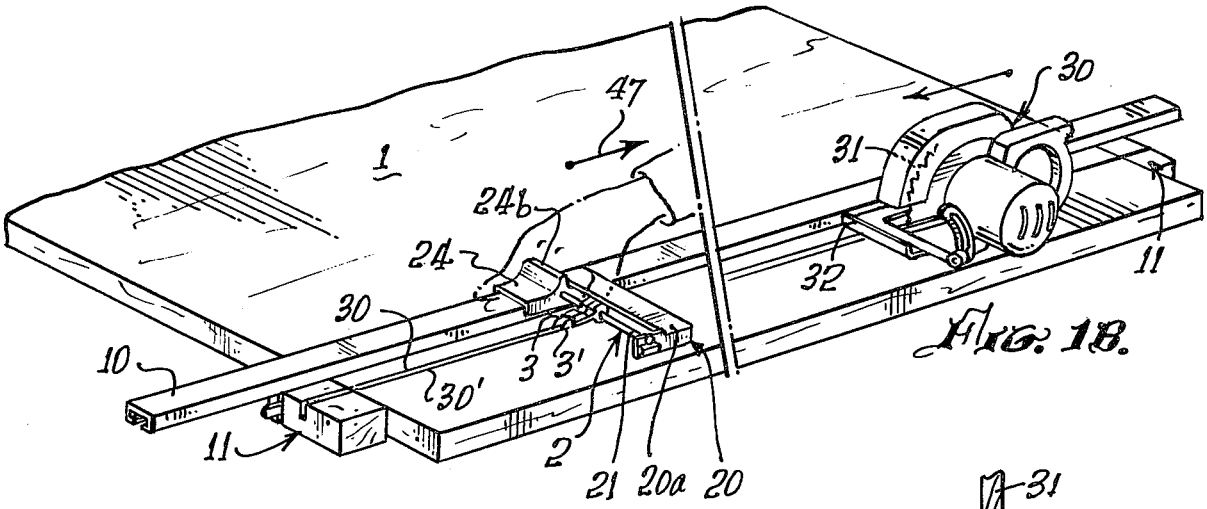
FIG. 1B.
FIG. 1A.
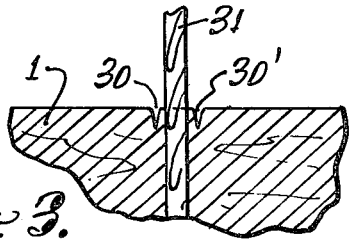
FIG. 3.
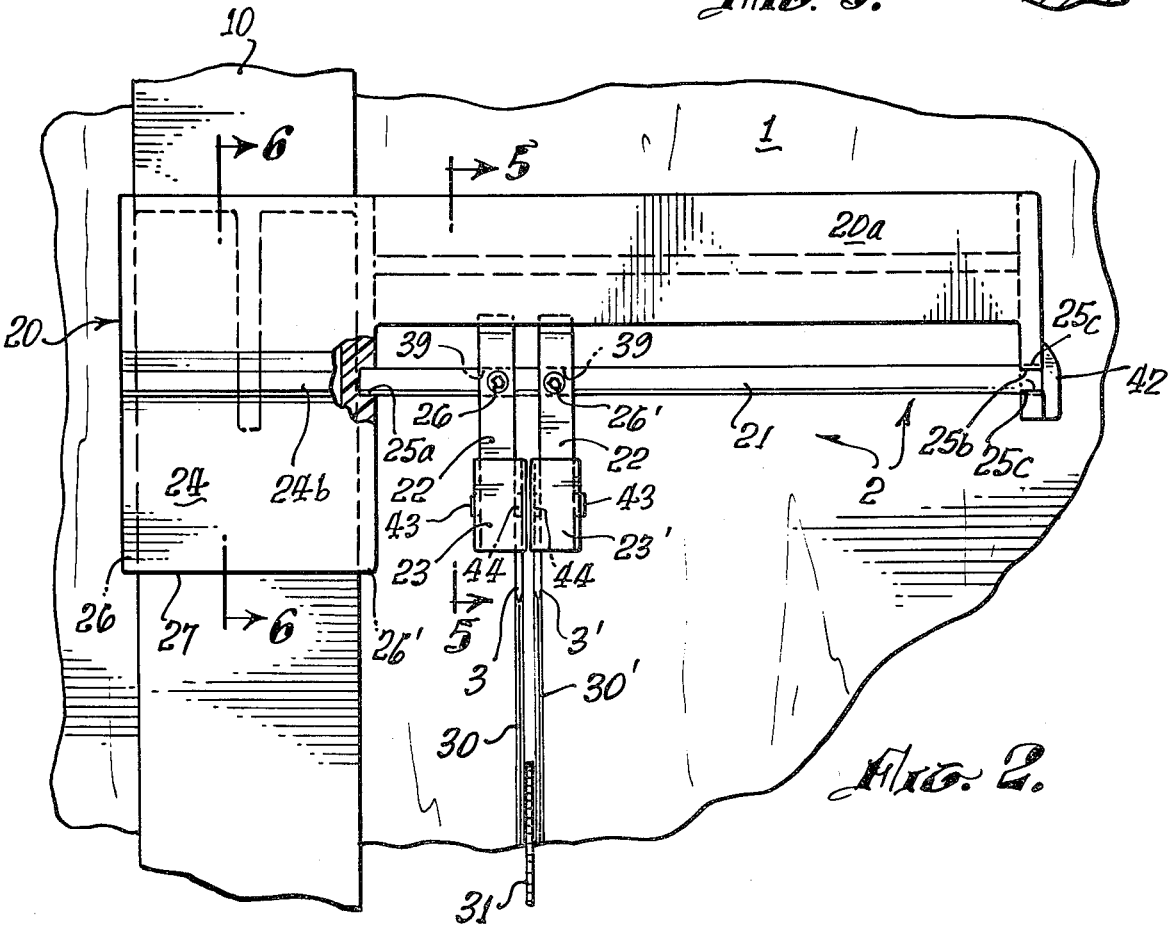
FIG. 2.

DEVICE FOR SCORING WOOD PANELS PRIOR TO SAWING

BACKGROUND OF THE INVENTION

Plywood panels have become widely used on the interior walls of buildings. Doors are commonly of wood veneer construction. In carpentry the traditional handsaw has been largely replaced by the portable power circular handsaw and the saber saw.

The power circular handsaw, however, is not by itself a satisfactory tool for trimming doors or cutting thin wall panels or plywood, because it is difficult to guide accurately and because it tends to splinter or feather the veneer surface along the sides of the kerf.

A solution to the saw guiding problem is provided in my U.S. Pat. No. 4,065,114 which provides a guide bar clamped to the workpiece to insure an accurately straight saw cut along the desired line.

The present invention provides a solution to the splintered-edge problem. Preferably it makes use of the same guide bar.

My U.S. Pat. No. 4,058,150 relates to a prior scoring or scarfing device.

SUMMARY OF THE INVENTION

A motorized power circular handsaw will cut veneer panels across the grain of the top ply of wood cleanly without splintering the edges of the kerf, if the workpiece is properly scribed or scored beforehand. In this invention the scoring is done by a pair of knife blades. These are mounted side-by-side in suitable holders or arms on a shaft which is held in a frame. The frame is disposed to be guided by a guide bar which is clamped to the workpiece along a line parallel to the score lines. The same guide bar preferably also guides the saw after the scoring operation is complete.

The novel scoring device is manually drawn across the workpiece, scribing or scoring it in two closely-spaced parallel knife cuts which lie astride the path to be followed by the saw blade. The scoring may be about 0.5 mm to 2 mm deep.

When the power handsaw is pushed across the workpiece, guided by the same guide bar, its kerf will lie between the two score lines. These score lines or cuts stop the propagation of splintering, so that the saw cut is clean as well as straight.

In operation, the saw may be just barely entered into the side of the workpiece to locate precisely the line of the kerf. The scoring knife blade holders may then be adjusted along their shaft so that the score lines lie immediately along either side of the kerf. The scoring device is preferably then moved to the far side of the workpiece, away from the operator, and then drawn toward the operator to cut the score lines across the workpiece. The operator may then push the saw across the workpiece, guided by the guide bar, in the normal manner, to make a saw cut between the score lines.

Each scoring knife blade is secured removably by a clip to an individual blade arm. The two blade arms are mounted adjustably on a rotatable shaft. The ends of the shaft are carried in holes of bearings in the frame of the scoring device. The operator presses down on the tops of the blade arms to force the tips of the scoring blades into the workpiece, while drawing the whole device along the guide bar. The device is so constructed that this operation may be done with one hand.

BRIEF DESCRIPTION OF THE DRAWINGS

FIG. 1A is a perspective view of a scoring device of the invention in use on a workpiece;

FIG. 1B is a perspective view of a power circular handsaw on the same workpiece;

FIG. 2 is a general top view of a scoring device of the invention;

FIG. 3 is a sectional detail view of two scoring cuts and a portion of a saw blade;

DESCRIPTION OF THE PREFERRED EMBODIMENT

Figure 4:
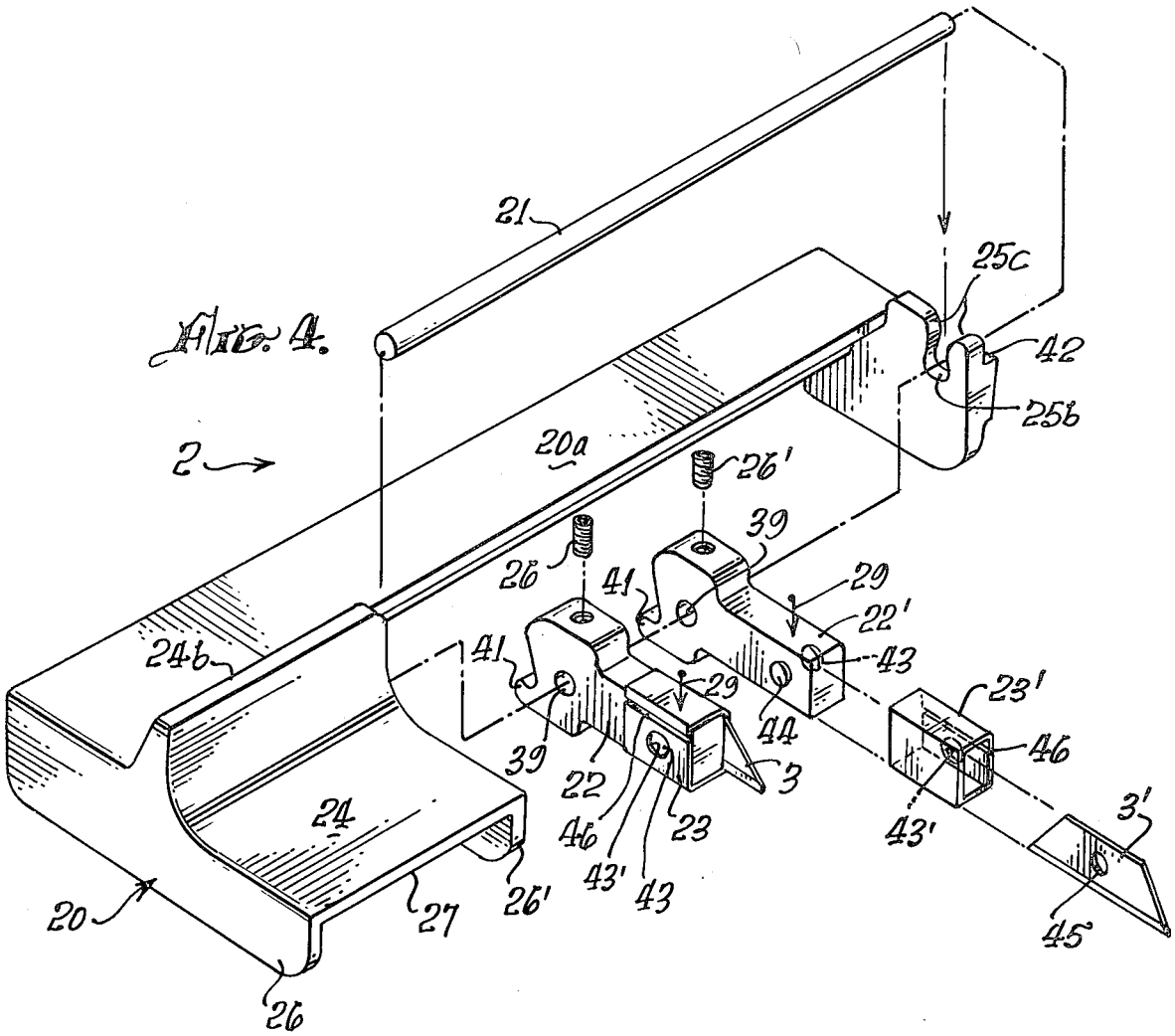
FIG. 4 is a complete exploded perspective view of a scoring device.

In FIGS. 1A and 1B, a guide bar 10 is shown clamped across a workpiece 1 (such as a plywood panel of veneer door) by suitable clamping means 11. In FIG. 1B a power circular handsaw 30 of any suitable conventional type with a shoe or slipper 32 is shown guided by guide bar 10 so as to produce a straight saw cut or kerf along a desired line across the workpiece 1. All these elements may be as described in my prior U.S. Pat. No. 4,065,114 referred to above.

FIG. 1A shows a scoring device of the present invention, indicated generally at 2, engaged with the same guide bar 10 and being drawn by hand across the workpiece 1. It is preferably drawn from the far side of the workpiece toward the operator, in a direction opposite to that in which the saw is pushed. The scoring device 2 comprises a frame 20 which carries a pair of knife blades 3, 3'. It will be described more fully later in connection with its more detailed showing in FIGS. 2, 4, 5 and 6.

Referring now to the sectional detail of FIG. 3, the knives 3, 3' cut score lines 30, 30' which lie immediately along each side of the kerf to be cut by the circular saw blade 31. Any surface splitting or feathering of the workpiece 1 will be stopped by the score lines 30, 30'. In use the knife blades 3, 3' are adjusted along their shaft so that they score the work very close to the kerf. When they are so adjusted, the saw will erase the score lines and leave a clean edge on the work. Little or no subsequent planing or sanding will be required.

FIG. 2 shows a top view of the scoring device 2 in position for use. Its frame 20 has a guide handle portion 24 which fits over the guide bar 10 and may be slid along it by the operator. An outboard side extension portion **20*a* of frame 20 provides an outboard end support 25*b* for a blade arm shaft 21. The inboard end of shaft 21 fits into an inboard support hole or bearing 25*a*. The shaft 21 fits into an inboard support hole or bearing 25*a*. The shaft 21** is rotatable in supports.

Clamped adjustably to this shaft 21 are two scoring knife blade carrier arms 22, 22', onto which are secured the knife blades 3, 3' by means of clips 23, 23'.

The handle portion 24 of frame 20 has a finger ridge portion **24*b*. In use, the operator pulls the handle portion 24 toward himself with the aid of finger ridge 24*b* and at the same time bears down on the knife blade arms 22, 22' to force the blade tips into the workpiece 1**, preferably using the index finger of the same hand.

FIG. 4 shows the structure of the scoring device more clearly in perspective, partly disassembled. The underside of the guided handle portion 24 of frame 20 is open in the general shape of a wide inverted channel with two parallel depending side arms 26, 26' defining side surface and a top surface 27 at right angles to the side surfaces; this fits slidably over the guide bar 10 as described above.

Bearing or support 25*b* for the outboard end of shaft 21 is located at the end of the outboard extension portion 20*a* of frame 20. The inboard support 25*a*, not visible in FIG. 4, is preferably in the form of a blind hole (FIG. 2); a suitable removable retainer may be provided at the outboard end 25*b* of the shaft 21, as at 42 in FIG. 2, or the shaft end may be resiliently retained by clip-like portions 25*c*.

Referring again to FIG. 4, the two scoring blade arms 22, 22' each have holes 43 through which shaft 21 passes. The arms may be positioned at any points desired along the length of shaft 21 in order to get the score lines correctly located on each side of the saw kerf line. The arms are held in place on the shaft by suitable clamping means such as set screws 28, 28'. Once the blade arms 22, 22' are set correctly along the shaft 21, they will not need readjustment except when a saw of different show-to-blade dimensions is used, or the saw blade is replaced by one of different thickness.

Figure 5:
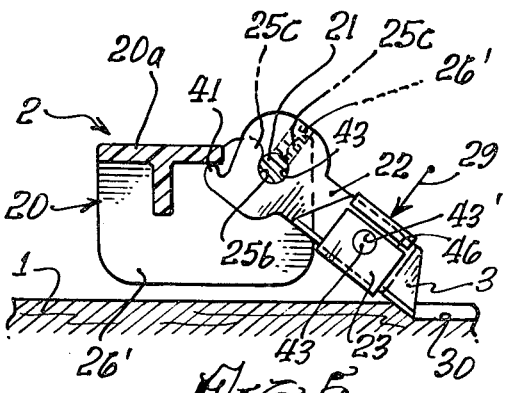
FIG. 5 is a sectional view on line 5—5 of FIG. 2.

The scribing or scoring knife blades 3, 3' are held onto their respective blade arms 22, 22' by blade clips 23, 23' which are preferably made of resilient sheet metal in a rectangular sleeve-like shape as shown in FIGS. 4 and 5. Other blade-holding devices may of course be used instead. The blades 3, 3' are preferably of a standard replaceable type commonly sold for use in knife handles for scoring and cutting sheet material and the like. They are provided with central holes 45. Bosses or pins 44 are provided on the blade arms 22, 22' to engage these holes. Similar bosses or pins 43 on the opposite side of each blade arm engage holes on the opposite side of each clip to hold the clip in place. The clips are cut along lines 46 so that they may be pried open, as with a knife blade, to permit them to be removed. To replace, they are simply pushed on.

A spur-like projection 41, FIGS. 4–5, is preferably provided at the rear portion of each blade arm 22, 22' to provide a depth limit stop. The projection 41 butts against the underside of the outboard extension portion 20*a* of the frame 20, FIG. 5, limiting the downward excursion of the scoring knife blades 3, 3'.

Figure 6:
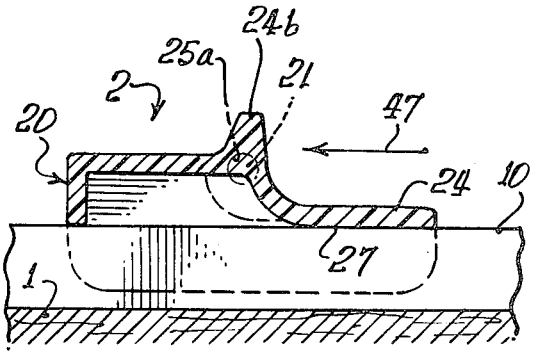
FIG. 6 is a sectional view on line 6—6 of FIG. 2.

FIG. 6 is a sectional view showing the finger ridge 24*b*. The operator's fingers hook over this ridge portion to draw the scoring device toward the operator in the direction of arrow 47. At the same time the operator presses down with his index finger on the tops of the blade arms 22, 22', FIG. 1. These points of downward pressure are indicated by arrows 29 in FIGS. 4 and 5.

The frame 20 of the scoring device 2 may preferably be molded as a unit from a suitable plastic. Such plastic material is preferably slightly resilient, so that the ear or clip-like portions 25*s* (FIG. 4) retain the outboard end of shaft 21 when the shaft is pushed down between them. The blade carrier arms 22, 22' may also be molded of plastic. Obviously die-casting or other suitable types of construction may be used instead.

The inventor claims:

1. A scoring device for a wood panel or like workpiece, comprising:

a guide bar adapted to guide a saw to saw said workpiece along a predetermined kerf line, means to clamp said bar to said workpiece parallel to said kerf line, a scoring device frame having a guided portion configurated to fit onto said guide bar and slidable therealong, an outboard extension portion of said frame extending generally parallel to the workpiece at substantially a right angle to said guide bar, a pair of knife-carrying means mounted on said extension portion and adjustable in position therealong, a scoring knife blade attached to each said knife-carrying means, whereby said knife blades may be adjusted to score simultaneously along either side of said kerf line, said scoring preventing splintering of the surface of said workpiece by said saw, each said knife-carrying means comprises knife blade arm means having a shaft hole, shaft means extending through each said shaft hole, a support in said guided portion of said frame receiving rotatably an inboard end portion of said shaft means, a bearing suppport in said outboard extension portion of said frame receiving rotatably an outboard end portion of said shaft means, clamping means to secure each said arm means to said shaft at a selected position along the length of said shaft means, a resilient clip extending generally around said arm means to hold said knife blade against its side, said blade having a first hole through its side portion, a first boss on said arm engaging said hole, a cut in said clip along a side portion thereof and a second hole adjacent said cut, and a second boss on said arm engaging said second hole releasably to retain said clip along the length of said arm.

2. A scoring device as in claim 1, wherein:

said guided portion of said frame has a channel-like recess on its underside to fit slidably over said guide bar, and a ridge portion on its upper side;

said ridge portion being adapted to be engaged by fingers of an operator's hand to draw said frame along said guide bar toward said operator, and the top portions of said arms being adapted to be pressed downward by other fingers of the hand to force said knife blades into said workpiece.

3. A scoring device as in claim 1, wherein:

each said arm has a projecting spur portion on its inner end portion, said spur portion being adapted to abut against an underside portion of said frame to provide a limit stop to the depth of cut of said knife blade.

4. A scoring device for a wood panel or like workpiece, comprising:

a guide bar adapted to guide a saw to saw said workpiece along a predetermined kerf line, means to clamp said bar to said workpiece parallel to said kerf line, a scoring device frame having a guided handle portion configuration to fit onto said guide bar and having at least one side surface to retain the frame slidably on the guide bar, an outboard extension portion of said frame extending generally parallel to the workpiece at substantially a right angle to said guide bar, a pair of knife-carrying arm means mounted on said extension portion and adjustable in position therealong, and a scoring knife blade attached to each said knife-carrying means, whereby said knife blades may be adjusted to score simultaneously along either side of said kerf line, said scoring preventing splintering of the surface of said workpiece by said saw.

5. A scoring device according to claim 4, wherein:

said guided handle portion of said frame has a recess adapted to fit over said guide bar to slidably mount the frame thereon, and said guided handle portion has a ridge portion being adapted to be engaged manually by an operator to draw said frame along said guide bar while the top portions of said arms are manually pressed downward to force said knife blades into said workpiece.

6. A scoring device according to claim 4, and further including:

shaft means rotatably mounted on the frame, each of the arm means being mounted on the shaft means, and securing means interengaging the shaft means and each arm means for securing each arm means at a selected position along the shaft means.

7. A scoring device according to claim 5, and further including:

shaft means rotatably mounted on the frame, each of the arm means being mounted on the shaft means, and securing means interengaging the shaft means and each arm means for securing each arm means at a selected position along the shaft means.

8. A scoring device as in claim 6, and further including:

a resilient clip extending generally around said arm means to hold said knife blade against its side, said blade having a first hole through its side portion, a first boss on said arm engaging said hole, a cut in said clip along a side portion thereof and a second hole adjacent said cut, and a second boss on said arm engaging said second hole releasably to retain said clip along the length of said arm.

9. A scoring device according to claim 4, and further including:

resilient clip means disposed about each of said arm means to hold said knife blade on the arm means, and retaining means interengaging the clip means and arm means to retain the clip means on the arm means.

10. A scoring device according to claim 6, and further including:

resilient clip means disposed about each of said arm means to hold said knife blade on the arm means, and retaining means interengaging the clip means and arm means to retain the clip means on the arm means.

* * * * *